US010519738B2

(12) United States Patent
Ferrara et al.

(10) Patent No.: US 10,519,738 B2
(45) Date of Patent: Dec. 31, 2019

(54) SAFETY VALVE FOR PRODUCTION WELLS

(71) Applicant: ENI S.p.A., Rome (IT)

(72) Inventors: Paolo Ferrara, Milan (IT); Giuseppe De Grandis, Spoltore (IT); Andrea Biondi, Albignasego (IT)

(73) Assignee: ENI S.p.A., Rome (IT)

( * ) Notice: Subject to any disclaimer, the term of this patent is extended or adjusted under 35 U.S.C. 154(b) by 284 days.

(21) Appl. No.: 15/520,629

(22) PCT Filed: Oct. 19, 2015

(86) PCT No.: PCT/IB2015/058019
§ 371 (c)(1),
(2) Date: Apr. 20, 2017

(87) PCT Pub. No.: WO2016/063191
PCT Pub. Date: Apr. 28, 2016

(65) Prior Publication Data

US 2017/0314355 A1 Nov. 2, 2017

(30) Foreign Application Priority Data

Oct. 22, 2014 (IT) ..... MI2014A1821

(51) Int. Cl.
*E21B 29/08* (2006.01)
*E21B 29/00* (2006.01)
(Continued)

(52) U.S. Cl.
CPC ..... *E21B 29/08* (2013.01); *E21B 33/0355* (2013.01); *E21B 33/064* (2013.01); *E21B 34/045* (2013.01); *E21B 34/16* (2013.01)

(58) Field of Classification Search
CPC ..... E21B 29/08; E21B 33/063; E21B 29/00; E21B 33/06; E21B 33/064
See application file for complete search history.

(56) References Cited

U.S. PATENT DOCUMENTS 1,851,894 A 3/1932 Clough et al.
3,590,920 A * 7/1971 Orund ..... E21B 29/08 166/361
(Continued)

FOREIGN PATENT DOCUMENTS

CN 101984214 A 3/2011
CN 201902656 U 7/2011
CN 202483484 U 10/2012

OTHER PUBLICATIONS

Combined Chinese Office Action and Search Report dated Sep. 12, 2018, in Patent Application No. 201580063692.7 (with English translation), citing documents AO-AQ therein, 14 pages.
(Continued)

*Primary Examiner* — Catherine Loikith
(74) *Attorney, Agent, or Firm* — Oblon, McClelland, Maier & Neustadt, L.L.P.

(57) ABSTRACT

A safety valve for extraction wells, configured to be installed on a well head and to enclose a tubular material portion inserted inside the well. The tubular material is internally hollow to contain and transport substances extracted from the well. The safety valve includes: a central hole through which the tubular material passes; a blocking system configured to keep the tubular material to be cut fixed with respect to the safety valve; a cutting and closing group configured to cut and close the well under certain operative conditions; and a sealing mechanism configured to effect watertight closing of the well, after the cutting. The cutting and closing group includes a hole saw housed in a respective chamber of the cutting and closing group, rotated by a motorized actuator, and configured to move in a controlled mode along a substantially orthogonal direction with respect to a development direction of the well.

16 Claims, 21 Drawing Sheets

(51) Int. Cl.

| | |
|---|---|
| ***E21B 33/06*** | (2006.01) |
| ***E21B 33/064*** | (2006.01) |
| ***E21B 33/035*** | (2006.01) |
| ***E21B 34/04*** | (2006.01) |
| ***E21B 34/16*** | (2006.01) |

(56) References Cited

U.S. PATENT DOCUMENTS

| | | | | |
|---|---|---|---|---|
| 3,717,202 | A * | 2/1973 | Burrow | E21B 29/08 166/55 |
| 3,720,260 | A | 3/1973 | Duck et al. | |
| 3,738,424 | A * | 6/1973 | Osmun | E21B 29/08 166/298 |
| 5,161,617 | A * | 11/1992 | Marschke | E21B 29/08 137/318 |
| 2012/0085544 | A1 * | 4/2012 | Shilling | E21B 17/015 166/345 |

OTHER PUBLICATIONS

International Search Report and Written Opinion of the International Searching Authority dated Feb. 12, 2016 in PCT/IB2015/058019.

* cited by examiner

SAFETY VALVE FOR PRODUCTION WELLS

BACKGROUND

The present invention relates to a safety valve for extraction wells of hydrocarbons, such as, for example, extraction wells of petroleum and/or natural gas. In particular, the present invention relates to a safety valve to be installed on the well head beneath the conventional safety systems, called "blow-out preventers" or BOPs, or below the production cross. The present invention is to be used in the case of emergency during drilling, production and maintenance operations.

An extraction well of hydrocarbons is similar to a pipe having a substantially circular section or, in other words, a long pipeline. During drilling, the formation fluids are contained in the pores of the subsoil rock, they are subjected to the formation pressure and are retained in the rock by the counter-pressure exerted on the walls of the well hole by the drilling muds.

Should the formation fluids rise from the well towards the surface uncontrollably, there would be an eruption (blow-out) of said fluids in correspondence with the drilling plant, which is usually situated at the surface on the well head.

The systems currently used for the prevention of blow-out prevalently consist in the installation of blow-out preventers or BOPs. BOPs consist of a certain number of devices called "rams", configured for surrounding the tubular drilling material. Ram devices are capable of exerting, by means of a suitable element made of metallic or elastomeric material, a closing and hydraulic sealing action on the tubular drilling material present in their interior without necessarily shearing the tubular drilling material itself. Some ram devices, called "blind", close the well if no tubular material is present in the BOPs. Other ram devices which can be activated as an extreme possibility are so-called "shear rams" (shearing) which shear the drill pipe and allow the closing and sealing element to be inserted.

At present, blow-out preventers or BOPs have the following limits:

- they are capable of shearing only the body of the drill pipes; they cannot shear the ends, called "tool joints" of said pipes, which have a larger diameter with respect to the pipe bodies;
- they require maintenance and substitution of the sealing elements at the end of the drilling phases;
- in the case of shear rams, the shearing action is only optimal when the pipe is centered inside the BOPs.

BOPs also have additional problems in critical situations. If the drill string is compressed upwards by the well pressure, or if it is diverted laterally, for example, the type of shearing of the BOPs may not ensure the shearing of the drill pipes and the passage of the closing element. Furthermore, the passage of the shear rams envisages that the pipe be cut after a complete crushing of the section, which only takes place in the central part of the pipe. Finally, the area of the tool joints subjected to the action of the cutting edges of the shear rams tends to break with reduced crushing and with completely unforeseeable fracture lines. Some metal debris may therefore remain entrapped, blocking the ram devices and consequently preventing the closing of the well.

BRIEF SUMMARY

The objective of the present invention is therefore to provide a safety valve for extraction wells of hydrocarbons which is capable of solving the above-mentioned drawbacks of the known art, allowing the well to be closed after a possible failure of the BOPs.

More specifically, an objective of the present invention is to provide a safety valve for extraction wells of hydrocarbons which allows the tubular material possibly present in the safety valve, to be cut and the well closed with hydraulic sealing, allowing the subsequent application of suitable intervention plans for controlling the well if the BOPs have proved to be ineffective.

A further objective of the present invention is to provide a safety valve for extraction wells of hydrocarbons which is capable of exerting the shearing action of the tubular material with a higher capacity than conventional BOPs, considering the worst stress conditions created in correspondence with the well head not currently envisaged by said BOPs. In particular, the safety valve according to the invention is capable of cutting/shearing a wide range of tubular materials in its interior.

Another objective of the present invention is to provide a safety valve for extraction wells of hydrocarbons which is capable of exerting the cutting action and closing of the well with hydraulic sealing with a greater reliability with respect to BOPs.

These objectives according to the present invention are achieved by providing a safety valve for extraction wells of hydrocarbons as specified in claim 1.

Further characteristics of the invention are indicated in the dependent claims, which are an integral part of the present description.

The safety valve according to the invention is provided with its own control unit and independent feeding. After the shearing operation, said safety valve is capable of closing the well, producing hydraulic sealing.

The actuation of the safety valve is of the reversible type for allowing the restoration of the well if this is possible. The actuation of the safety valve, which always occurs after the actuation of the BOPs and should their closing action and safeguarding of the well fail, can be operated either during a so-called "kick" phase (influx into the well of gas coming from geological formations), or possibly during a blow-out of the well. After installation, the safety valve can also be left on the well head during the production phase, when the BOP has been removed, remaining below the production cross, thus reducing environmental risks in the case of possible damage of the cross itself.

The safety valve according to the invention is capable of functioning by cutting tubular materials having larger dimensions than the pipe bodies and under critical operating conditions, for example with the tubular material in the BOP and under compression due to the pressure thrust of the well, or with the tubular material arranged randomly inside the safety valve.

BRIEF DESCRIPTION OF THE DRAWINGS

The characteristics and advantages of a safety valve for extraction wells of hydrocarbons according to the present invention will appear more evident from the following illustrative and non-limiting description, referring to the enclosed schematic drawings, in which.

DETAILED DESCRIPTION

Figure 1:
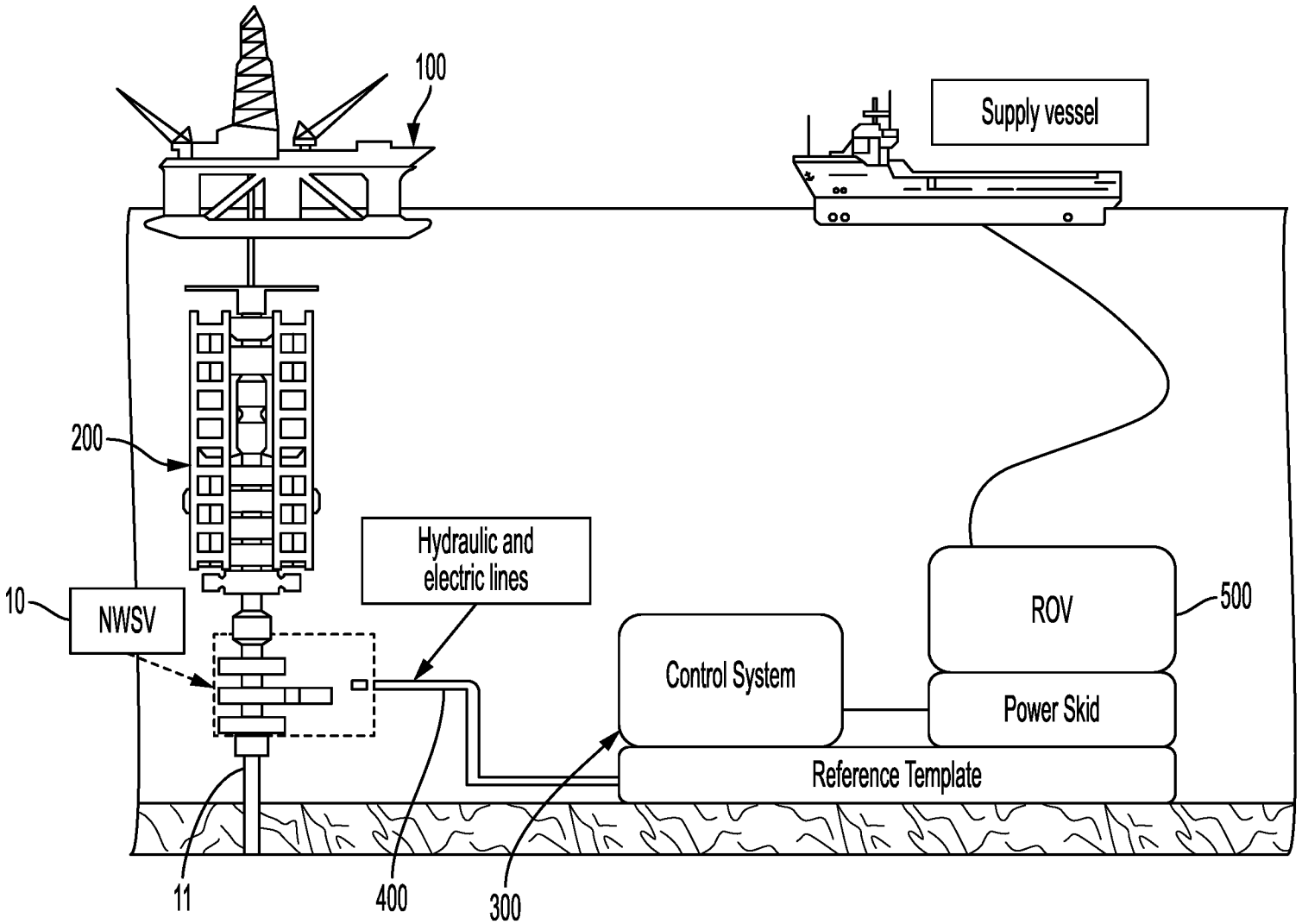
FIG. 1 is a schematic view of the safety valve according to the invention, positioned on an underwater well head, and the relative actuation systems.

With reference in particular to FIG. 1, this shows a generic floating drilling rig 100 set up for the drilling of an underwater well. The safety valve according to the invention, indicated as a whole with the reference number 10, is installed on the head 11 of the well so as to allow, during the drilling phases, the installation of blow-out preventers or BOPs, indicated as a whole with the reference number 200. At the end of the drilling, unlike the BOPs 200 which are removed, the safety valve 10 can remain installed for the whole operational duration of the well.

In particular, the safety valve 10 is configured to be installed on the well head 11 and to enclose a portion of a tubular material 12 inserted inside the well. The tubular material 12 can consist, for example, of a so-called "production tubing" or "pipe string" oriented in the same axial direction as the well. The tubular material 12 is internally hollow and is designed for containing and transporting fluids and other substances extracted from the well, among which, for example, hydrocarbons (petroleum or natural gas), water, sludge, rock debris and/or land debris.

The safety valve 10 is operated by a remote power and control system 300 which can be installed either at a drill construction site (in the case of land drillings), or on the sea bottom (in the case of off-shore drillings), at a predefined distance from the well head 11. The technical characteristics of the safety valve 10, as will be better explained hereunder, are such as to not require maintenance during the operating life of the safety valve 10 itself. The remote power and control system 300, however, can be removed to effect either programmed or occasional maintenance. In the case of off-shore drillings, the electric and hydraulic connections 400 between the remote power and control system 300 and the safety valve 10 can be operated by means of an underwater ROV ("remotely operated vehicle") 500, using suitable connectors called "ROV-mateable connectors".

Figure 2:
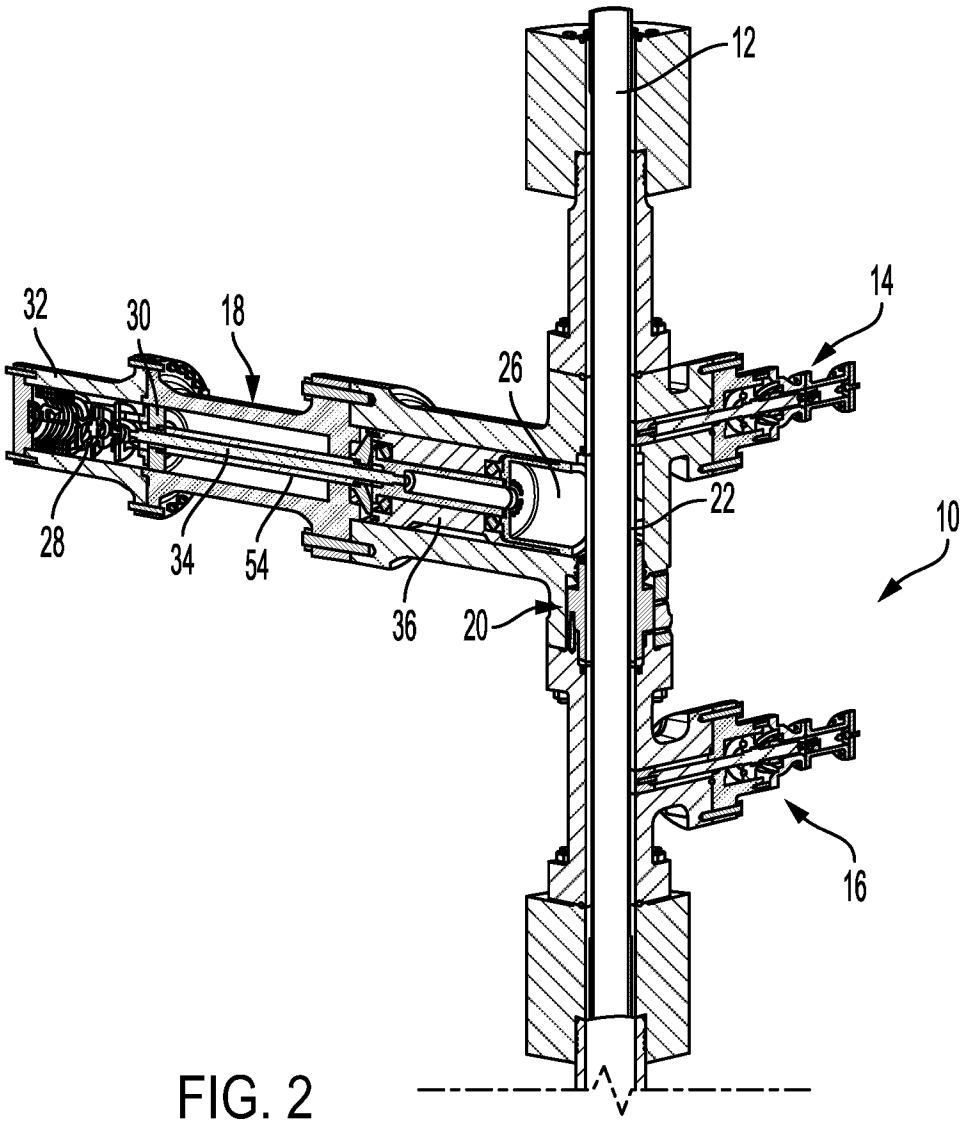
FIG. 2 is a sectional view of a preferred embodiment example of the safety valve according to the invention.
Figure 3:
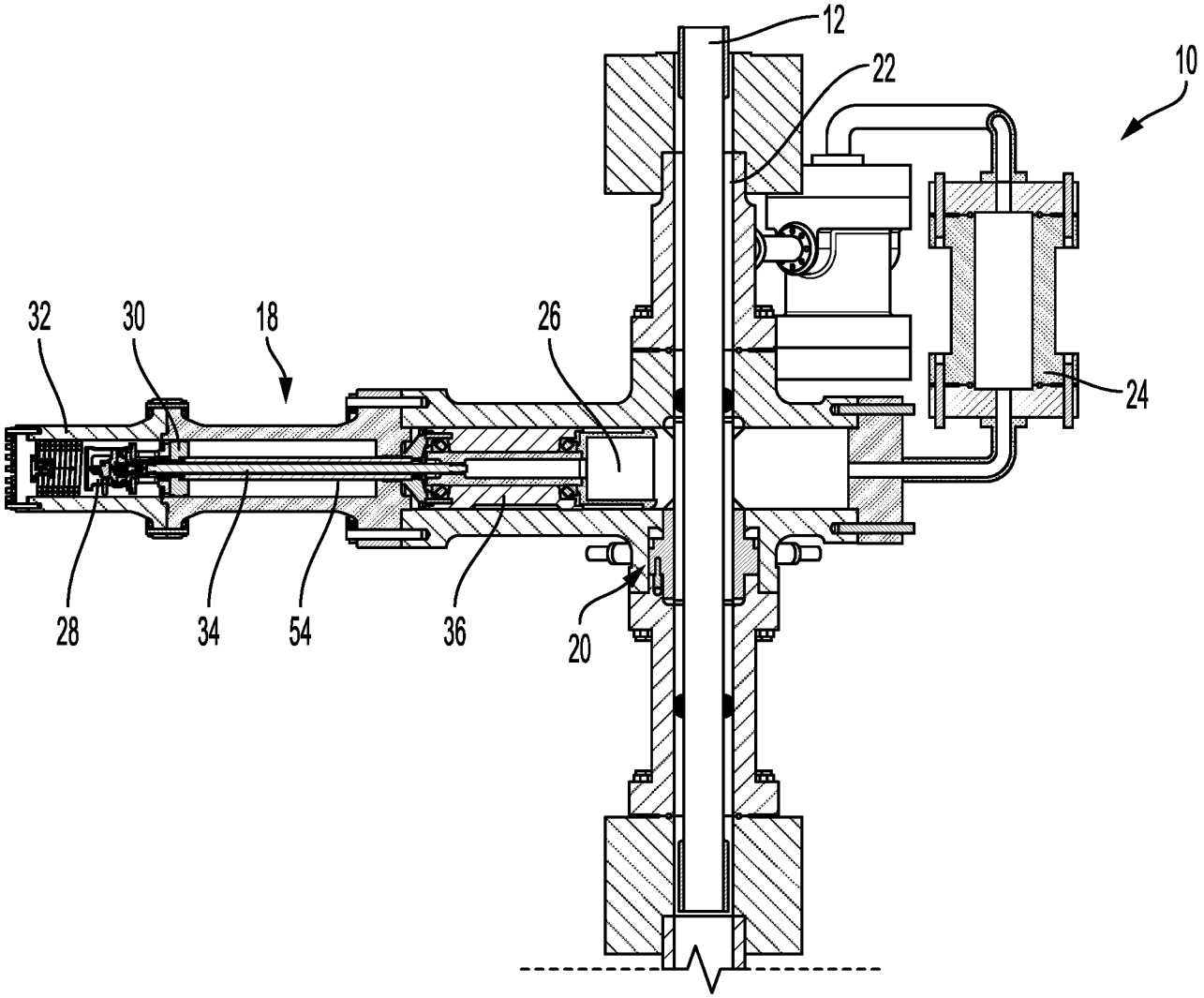
FIG. 3 is a sectional view of the safety valve of FIG. 2, provided with the relative pressure compensation device.

With reference to FIGS. 2 and 3, these show a preferred embodiment example of the safety valve 10 according to the invention. The safety valve 10 is composed of the following main components:

- a blocking system 14 and 16;
- a cutting and closing group 18;
- a sealing mechanism 20;
- a protection element 22; and
- a pressure compensation device 24.

The blocking system 14 and 16 is configured for keeping the tubular material 12 to be cut firmly fixed with respect to the safety valve 10.

In particular, the blocking system 14 and 16 consists of at least one upper blocking clamp 14, positioned above the cutting and closing group 18, and at least one lower blocking clamp 16, positioned below the cutting and closing group 18. The upper 14 and lower 16 blocking clamps therefore have the function of keeping the tubular material 12 fixed with respect to the safety valve 10 during the cutting action of the tubular material 12 on the part of the cutting and closing group 18. Two upper blocking clamps 14 and two lower blocking clamps 16 consisting of respective blocking elements 38 activated by opposing hydraulic pistons 40, are preferably envisaged. It should be pointed out that, in the present description, the terms "upper" and "lower" should be considered as defining the position of specific components of the safety valve 10 with reference to the development direction (deep into the ground) of the well.

The cutting and closing group 18 is configured for shearing the tubular material 12 under certain operative conditions of the well. The cutting and closing group 18 advantageously consists of a hole saw 26 rotated by a motorized actuation means 28, typically consisting of a hydraulic motor or also an electric motor.

On the basis of preferred embodiments of the safety valve 10 according to the invention, the hole saw 26 is configured for effecting the cutting of tubular materials having diameters and thicknesses defined as follows:

- casings having an external diameter preferably ranging from 1" to 20", with a wall thickness preferably up to about 20 mm,
- drill pipes having an external diameter preferably ranging from 1" to 10", with a wall thickness preferably up to about 20 mm,
- tool joints having an external diameter preferably ranging from 1" to 10", with a wall thickness preferably up to about 40 mm,
- protective collars having an external diameter preferably ranging from 1" to 24", with a wall thickness preferably up to 20 mm.

The hole saw 26 is configured for moving in a controlled mode along a substantially orthogonal direction with respect to the development direction of the tubular material 12. The control function of the linear movement of the hole saw 26 is exerted by a hydraulic piston 30 housed inside a respective cylinder 32 operatively connected to the cutting and closing group 18. The hydraulic motor 28, which rotates the hole saw 26 by means of a transmission shaft 34 inserted inside the stem 54 of the hydraulic piston 30, is also housed inside the cylinder 32.

A movable element 36 having a substantially cylindrical form, which at least partially surrounds the hole saw 26 and which is capable of advancing along the same direction as said hole saw 26 to interact with the tubular material 12, is slidingly inserted inside the cutting and closing group 18.

As specified in more detail hereunder, the movable element 36 is configured for being abutted against the sealing portion 64 of a sliding closing collar 62 of the sealing mechanism 20, so as to effect the watertight closing of the central hole of the safety valve 10 and consequently of the well.

Figure 4:
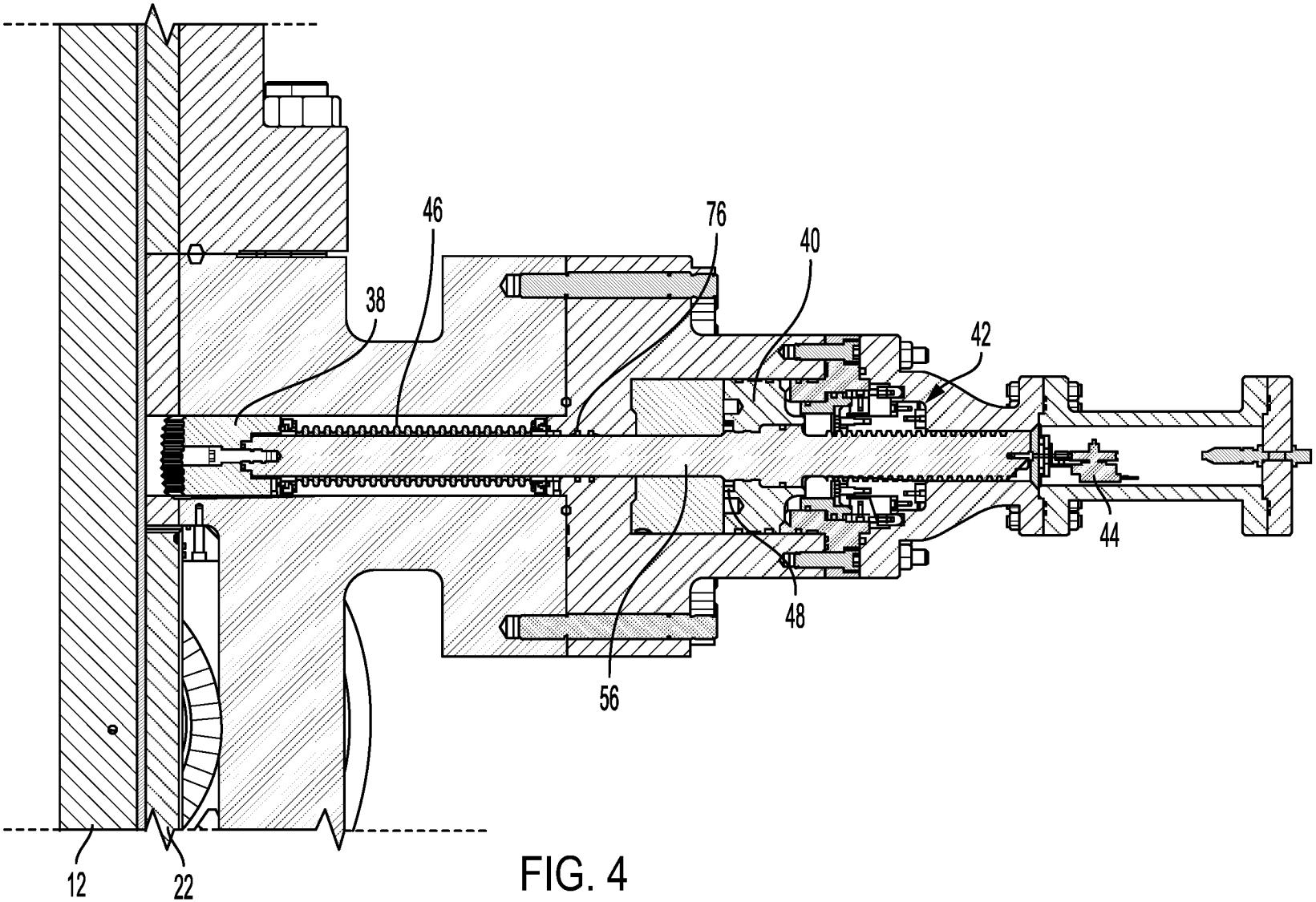
FIG. 4 is a sectional view of the blockage system of the safety valve of FIG. 2.

With reference to FIG. 4, this shows a single blocking clamp 14 of the blocking system of the safety valve 10 according to the invention. Each blocking clamp 14 or 16 consists of a blocking element 38 capable of engaging the tubular material 12 by interference. The blocking element 38 can be moved along a direction perpendicular to the axial direction of the tubular material 12 and is pushed by a hydraulically driven piston 40. A mechanism 42, preferably a screw mechanism, is assembled behind the piston 40, i.e. in an opposite position with respect to the position of the blocking element 38, which allows the blocking of said piston 40 in the position reached also in the case of a loss in the hydraulic pressure.

The screw mechanism 42 can be actuated in the release phase, through the action of the pressure of a fluid which activates the piston 40. A position sensor 44, which allows the stroke of the blocking element 38 to be exactly controlled so as to center the portion of tubular material 12 enclosed inside the safety valve 10, is assembled in the rear part of the blocking clamp 14 or 16, i.e. behind the screw mechanism 42.

The seals 48 and 76 of the stem 56 of the piston 40 and of the blocking element 38 are protected by the well fluids by means of an elastic bellows 46. This elastic bellows 46 allows small movements of the piston 40. Said movements, set at regular time intervals, are necessary for lubricating the seals 48 and 76, avoiding the galling on the cylinder, as the latter must remain inactive for an extremely long period of time, and also for effecting the functional tests of the safety valve 10 according to the invention. When the blocking clamp 14 or 16 is to be actuated, the force of the piston 40 shears the elements that are holding the elastic bellows 46 on the stem 56, which continues its stroke necessary for causing the blockage of the tubular material 12.

Figure 5:
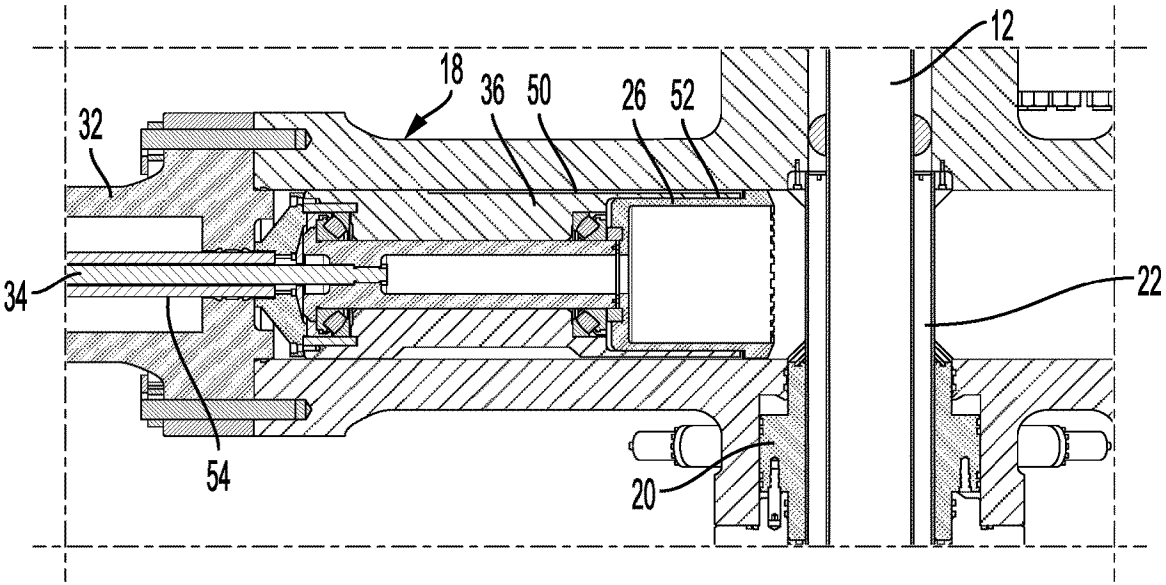
FIGS. 5 and 6 are sectional views of the cutting and closing group of the safety valve of FIG. 2.
Figure 6:
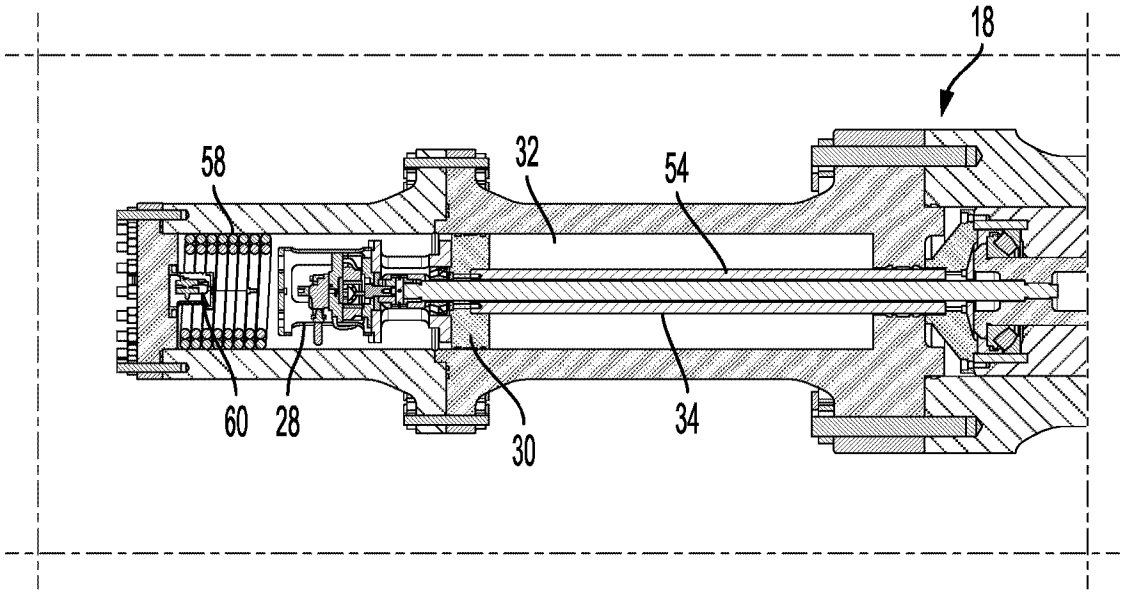

With reference to FIGS. 5 and 6, these show a cutting and closing group 18 of the safety valve 10 according to the invention. The cutting and closing group 18 comprises a hole saw 26 which rotates inside the movable element 36. Said movable element 36 therefore functions as a protection element for the hole saw 26. The rotation of the hole saw 26 takes place on bushings or bearings 50 protected by the cutting residues through an oil seal 52. Both the bearings 50 and the oil seal 52 are situated on the movable cylindrical element 36. This assembly configuration of the cutting and closing group 18 ensures that the hole saw 26 is only subjected to torsion, whereas other possible loads are supported by the movable cylindrical element 36 and do not cause flexion of the transmission shaft 34.

The rotation movement of the hole saw 26 is supplied by the hydraulic motor 28 by means of the transmission shaft 34 which rotates inside the stem 54 of the hydraulic piston 30. The hydraulic piston 30 which slides in the cylinder 32 pushes the stem 54, which in turn imparts the linear advance movement to both the hole saw 26, and to the movable cylindrical element 36. The hydraulic motor 28 is preferably integral with the hydraulic piston 30 and is fed by a series of flexible sleeves 58 which follow the hydraulic motor 28 itself during the translation movement of hydraulic piston 30. A linear sensor 60 continuously provides the position of the hydraulic piston 30 inside the respective cylinder 32.

After completing the cutting of the tubular material 12, the movable element 36 advances as far as a stroke-end, so that a closing portion thereof, having a high thickness, reaches the centre of the hole of the safety valve 10. The thickness of the closing portion of the movable element 36 is such as to resist the vertical thrust which is exerted inside the central hole of the safety valve 10 and which is due to the kick pressure.

Figure 7:
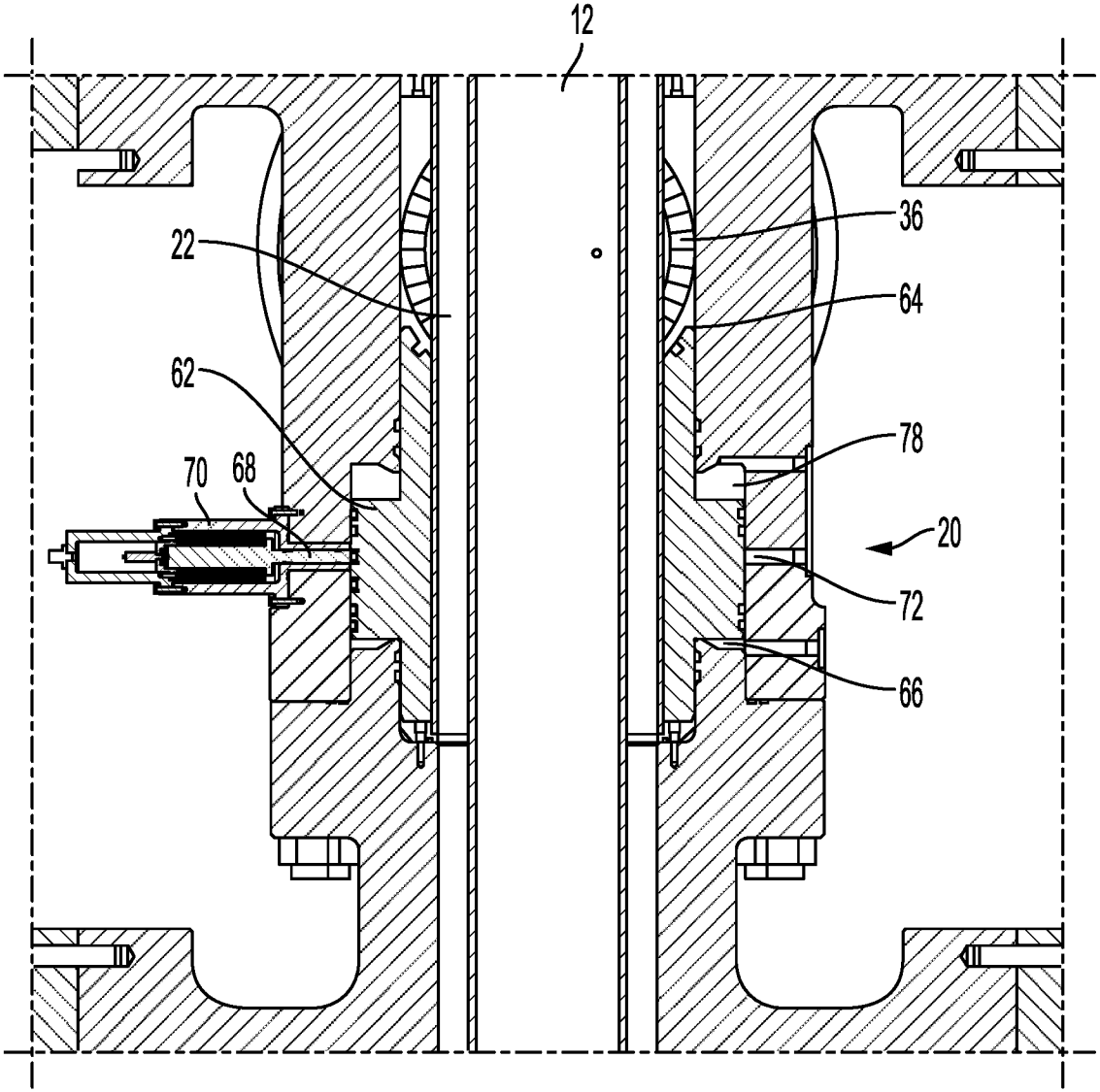
FIG. 7 is a sectional view of the sealing mechanism of the safety valve of FIG. 2.

With reference to FIG. 7, this shows the sealing mechanism 20 of the safety valve 10 according to the invention. The sealing mechanism 20 is conceived for effecting the closing of the well with hydraulic sealing. The sealing mechanism 20 is configured for enveloping the tubular material 12 inside the central hole of the safety valve 10 and is preferably positioned below the cutting and closing group 18. After the tubular material 12 has been cut and the movable cylindrical element 36 brought inside the central hole of the safety valve 10, the hydraulic sealing is obtained by means of the sliding closing collar 62 of the sealing mechanism 20. The sliding closing collar 62 is pushed upwards against the movable cylindrical element 36, forcing the sealing portion 64, formed on the upper edge of said sliding closing collar 62, against the cylindrical surface of the cylindrical element 36. The force necessary for actuating the sliding closing collar 62 is provided by the hydraulic pressure of a fluid contained in a lower thrust chamber 66 located inside the sealing mechanism 20.

Once the closing position has been reached, the sliding collar 62 is blocked by means of one or more blocking pins 68, so as to keep said sliding collar 62 in the closed position against the cylindrical element also in the absence of hydraulic pressure. The blocking pins 68 are pushed into corresponding grooves of the sliding closing collar 62 by means of one or more corresponding springs 70, and, when the movement of the same sliding closing collar 62 is required, the springs 70 are withdrawn by the thrust of a pressurized fluid contained in a respective chamber 72.

Figure 8:
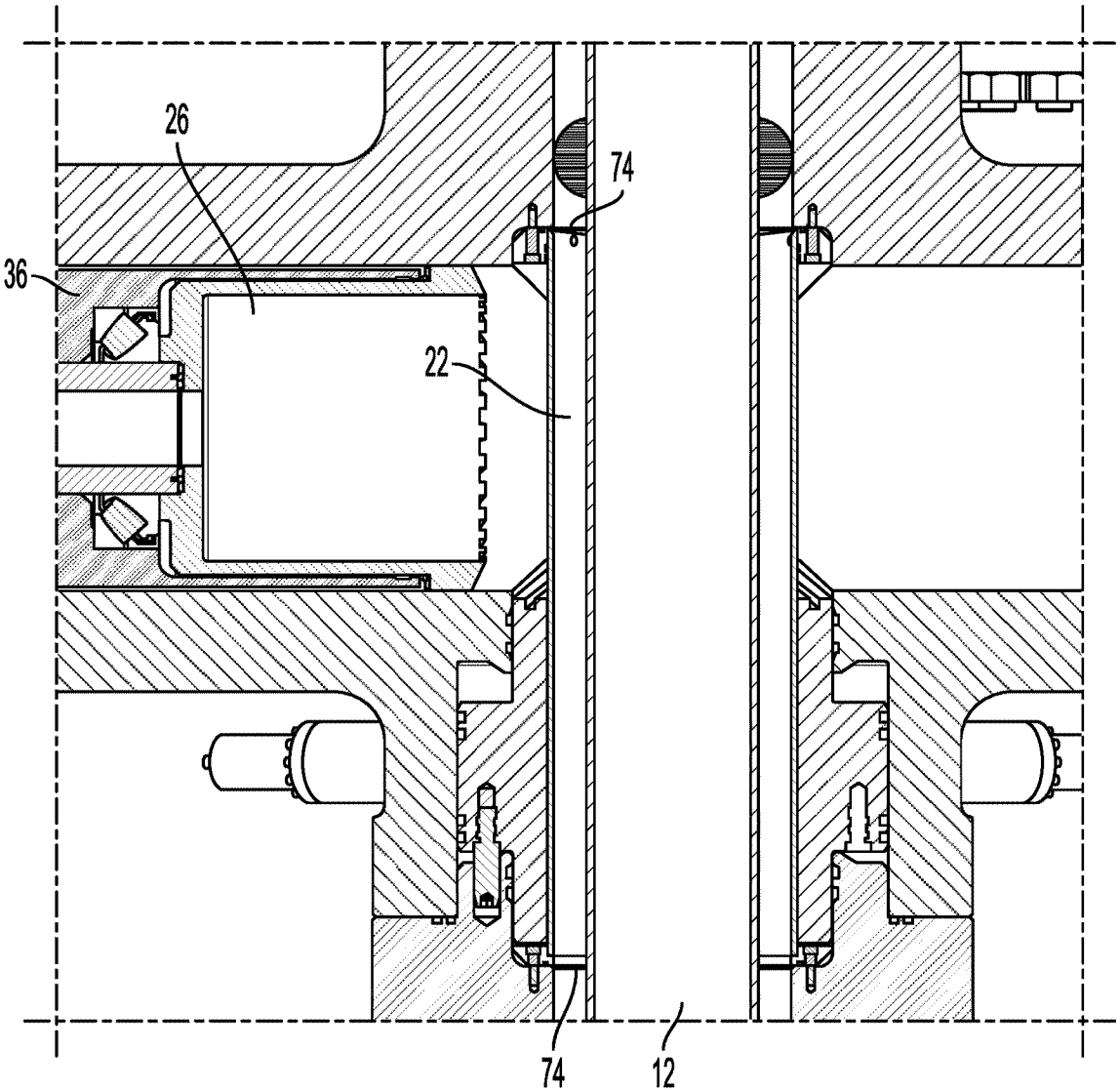
FIG. 8 is a sectional view of the protection element of the safety valve of FIG. 2.
Figure 9:
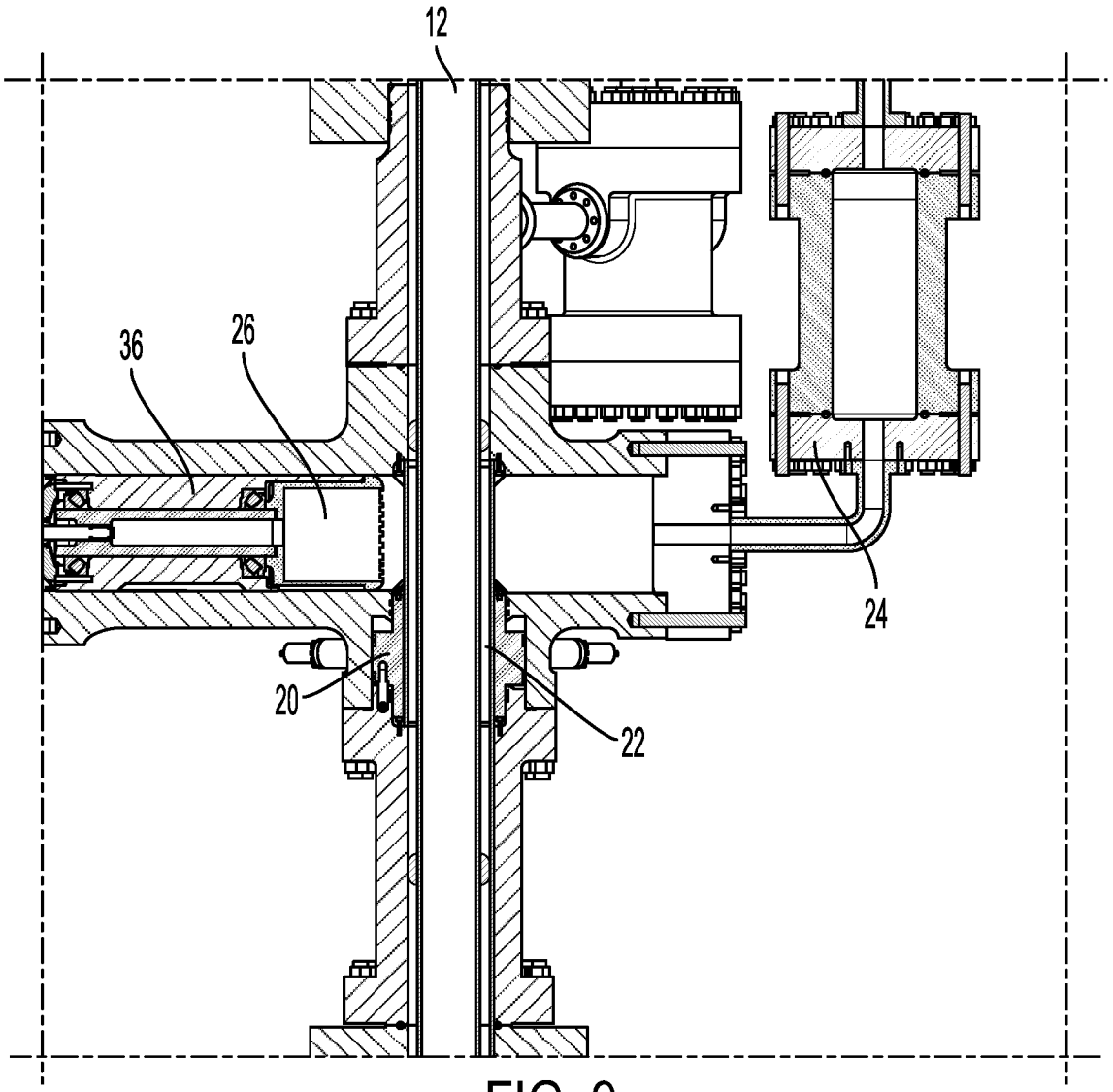
FIG. 9 is a sectional view of the pressure compensation device of the safety valve of FIG. 2.

With reference to FIGS. 8 and 9, these respectively show the protection element 22 and the pressure compensation device 24 of the safety valve 10 according to the invention. The safety valve 10, also after the drilling phase and completion of the well, must remain installed on the well head 11 below the production cross for the whole of its operating life. All the mechanical parts that are inside the safety valve 10, above all the seals of both the stem 54 of the hydraulic piston 30, and the transmission shaft 34 which transmits the rotation movement to the hole saw 26, must therefore remain protected firstly from the drilling sludge and secondly from the action of the completion fluid during the whole production life of the well.

For the above reasons, the safety valve 10 is provided with a protection element 22 consisting of a protection jacket or sleeve made of a metallic material having a reduced thickness. The protection jacket 22 is mounted around the tubular material 12 and coaxially with respect to it. The protection jacket 22 is provided with sealing rings 74 for keeping the central hole of the safety valve 10 separate from the chamber where the hole saw 26 is housed. This chamber is filled with an inert fluid kept at the same pressure as the well by means of the pressure compensation device 24. When the well is to be closed, the hole saw 26 also cuts the metallic protection jacket 22.

With reference to FIGS. 10A-10H, the operating sequence of the phases performed by the safety valve 10 for effecting the closing procedure of the well is as follows. A first phase (FIG. 10A) provides for the actuation of the pistons 40 of the upper 14 and lower 16 blocking clamps. The upper 14 and lower 16 blocking clamps which can be actuated independently, position the portion of tubular material 12 to be cut in the centre of the hole of the safety valve 10 and subsequently tighten said portion of tubular material 12 so as to support the axial load that weighs on the tubular material 12 itself.

The hydraulic motor 28 is subsequently actuated (FIG. 10B) in order to rotate the hole saw 26, until reaching the nominal rotation regime. The rotation regime of the hole saw 26 is controlled by measuring the flow-rate of the fluid which feeds the hydraulic motor 28 or by means of an appropriate rotary sensor positioned in correspondence with the hydraulic motor 28.

Figure 10A:
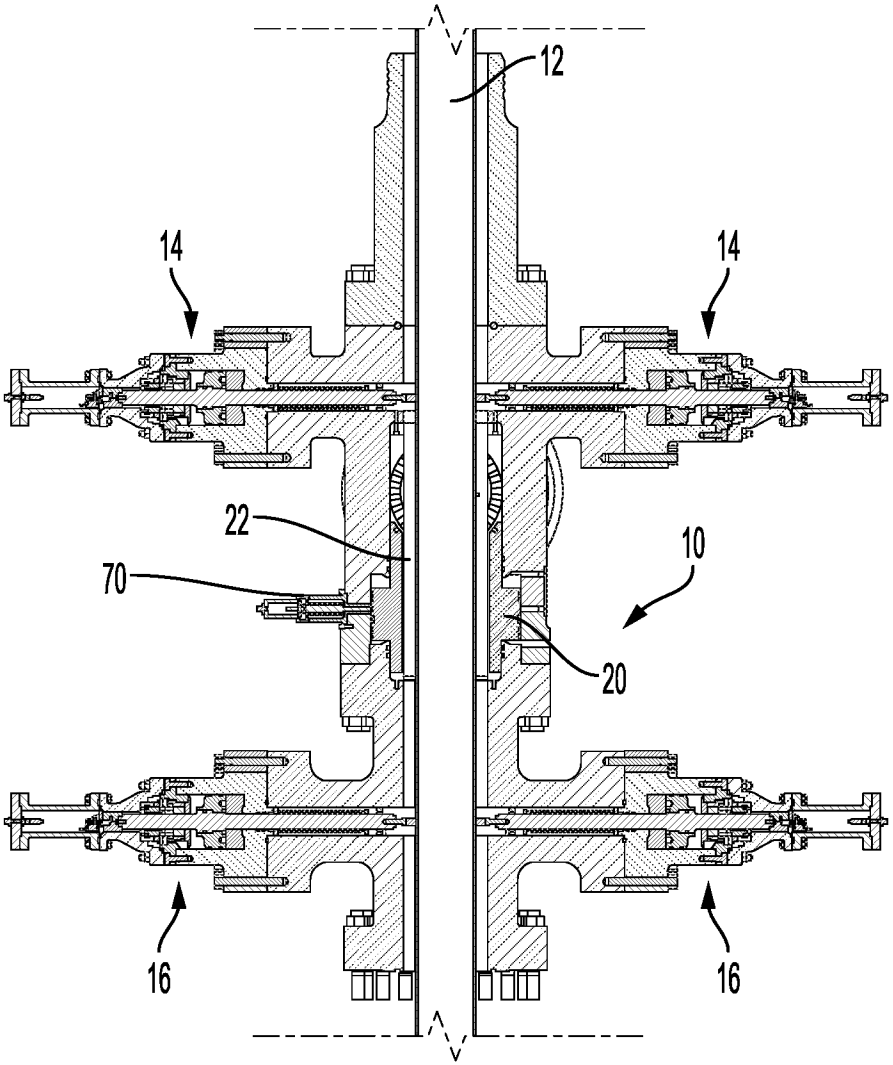
FIGS. 10A-10H respectively show the various phases of the actuation procedure of the safety valve of FIG. 2 to obtain the closing of the well.
Figure 10B:
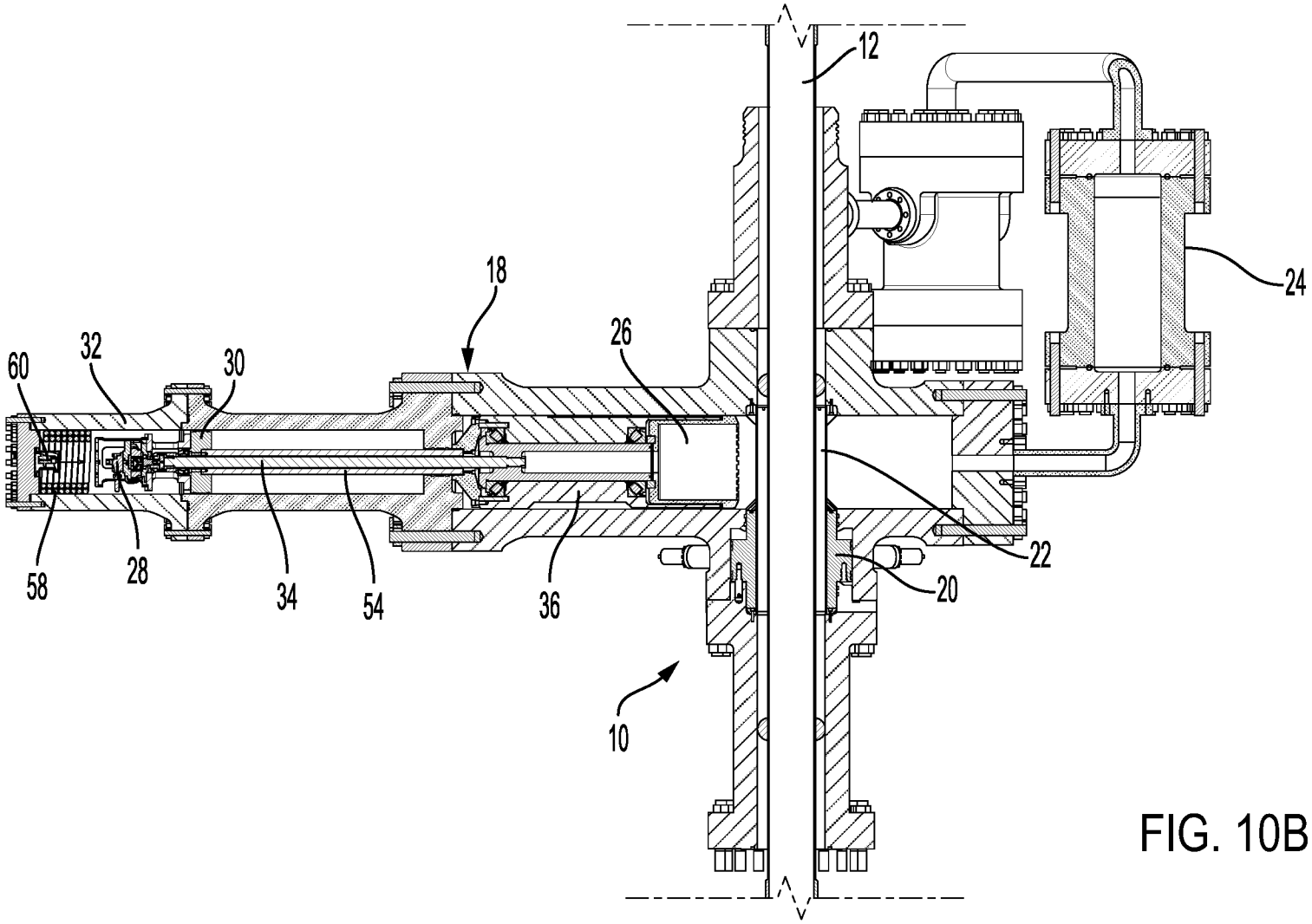
Figure 10C:
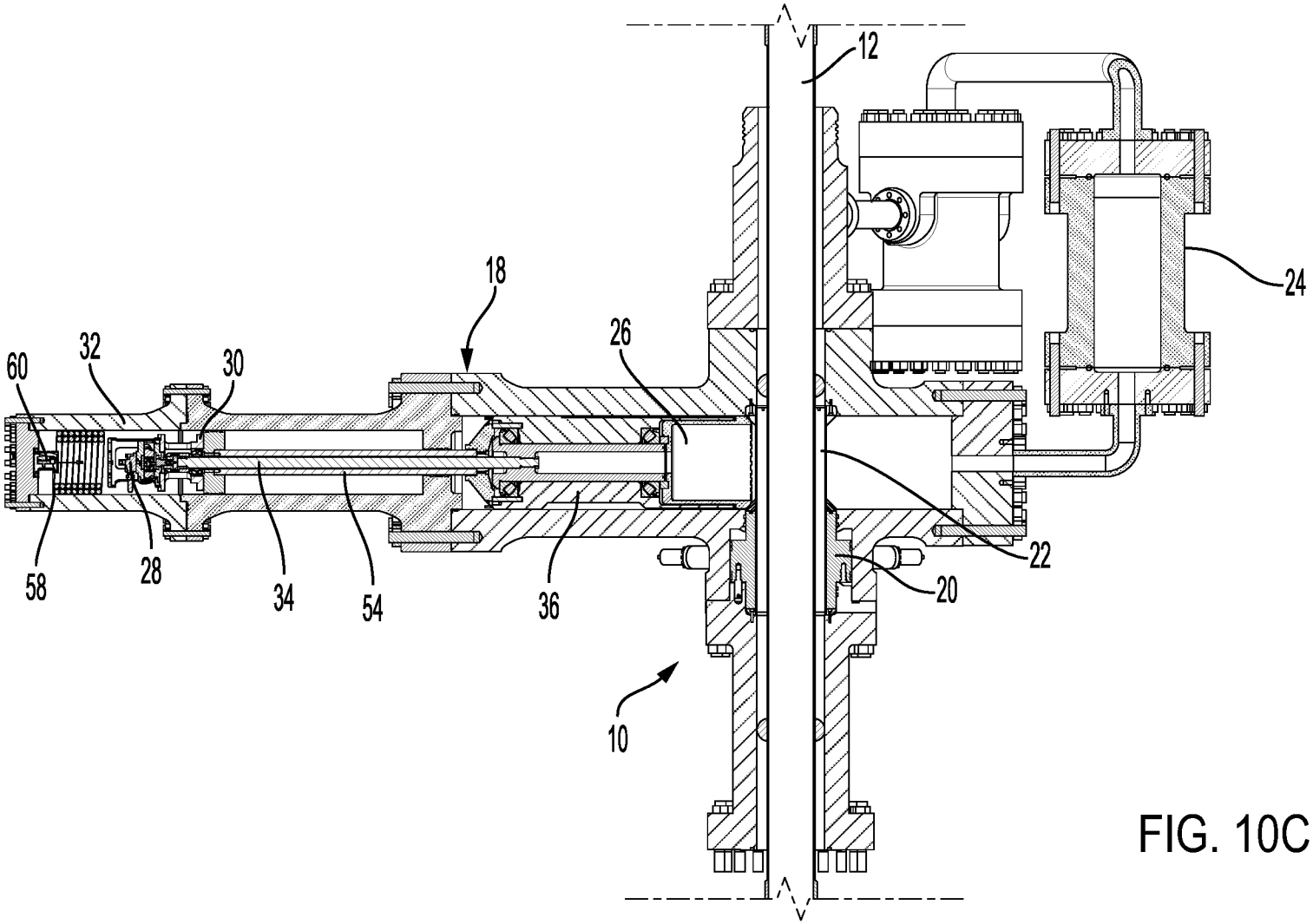
Figure 10D:
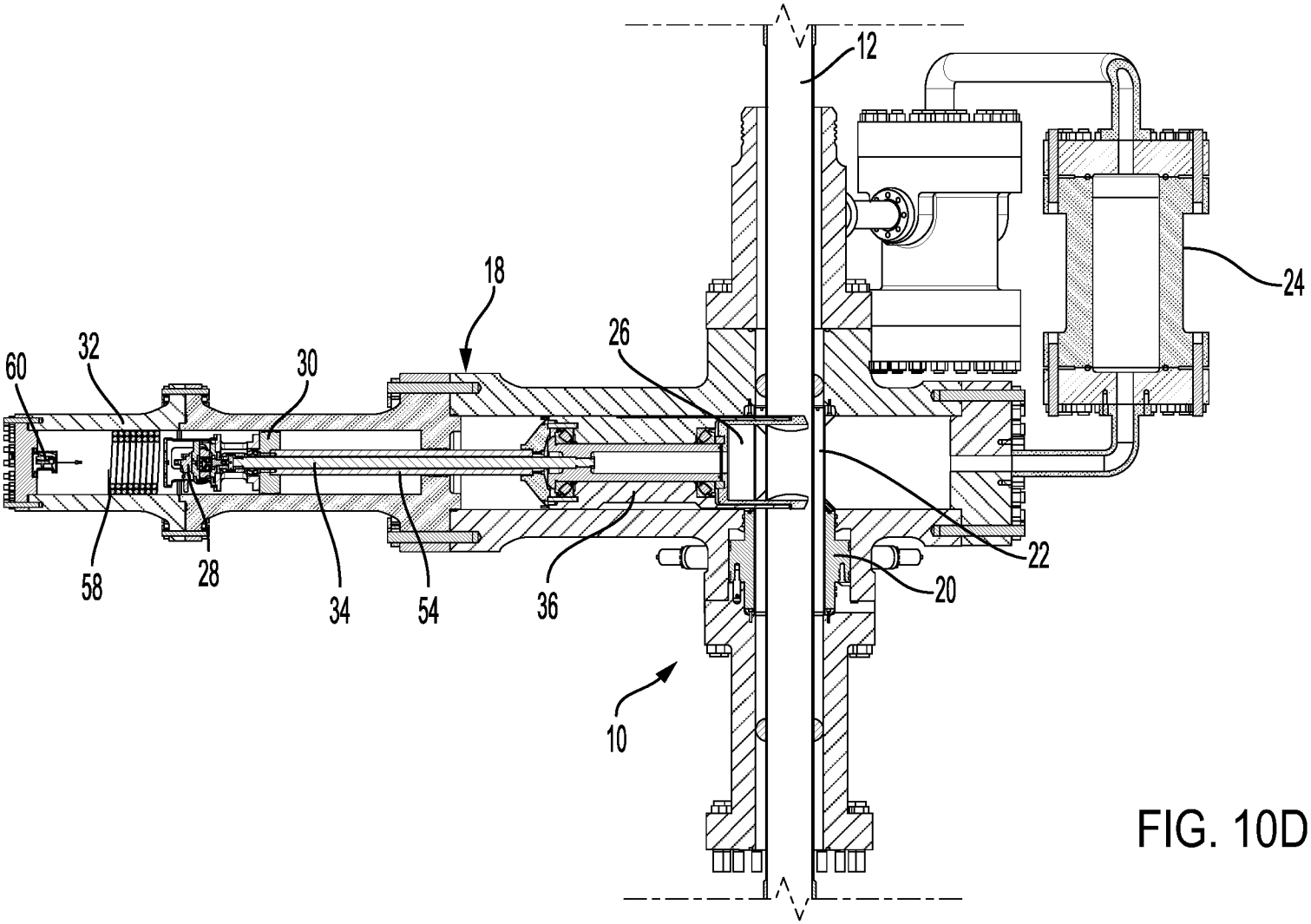

Once the hydraulic motor 28 has reached an optimal rotation regime, the hydraulic piston 30 is actuated in order to obtain the controlled linear movement of the hole saw 26 (FIG. 10C). The control is effected on the basis of the measurement of the position with the linear sensor 60 and by regulating the supply flow-rate of the actuation fluid to the cylinder 32. The controlled advancement of the hole saw 26 causes the cutting of the protection element 22 and subsequent progressive cutting of the tubular material 12 (FIG. 10D).

Figure 10E:
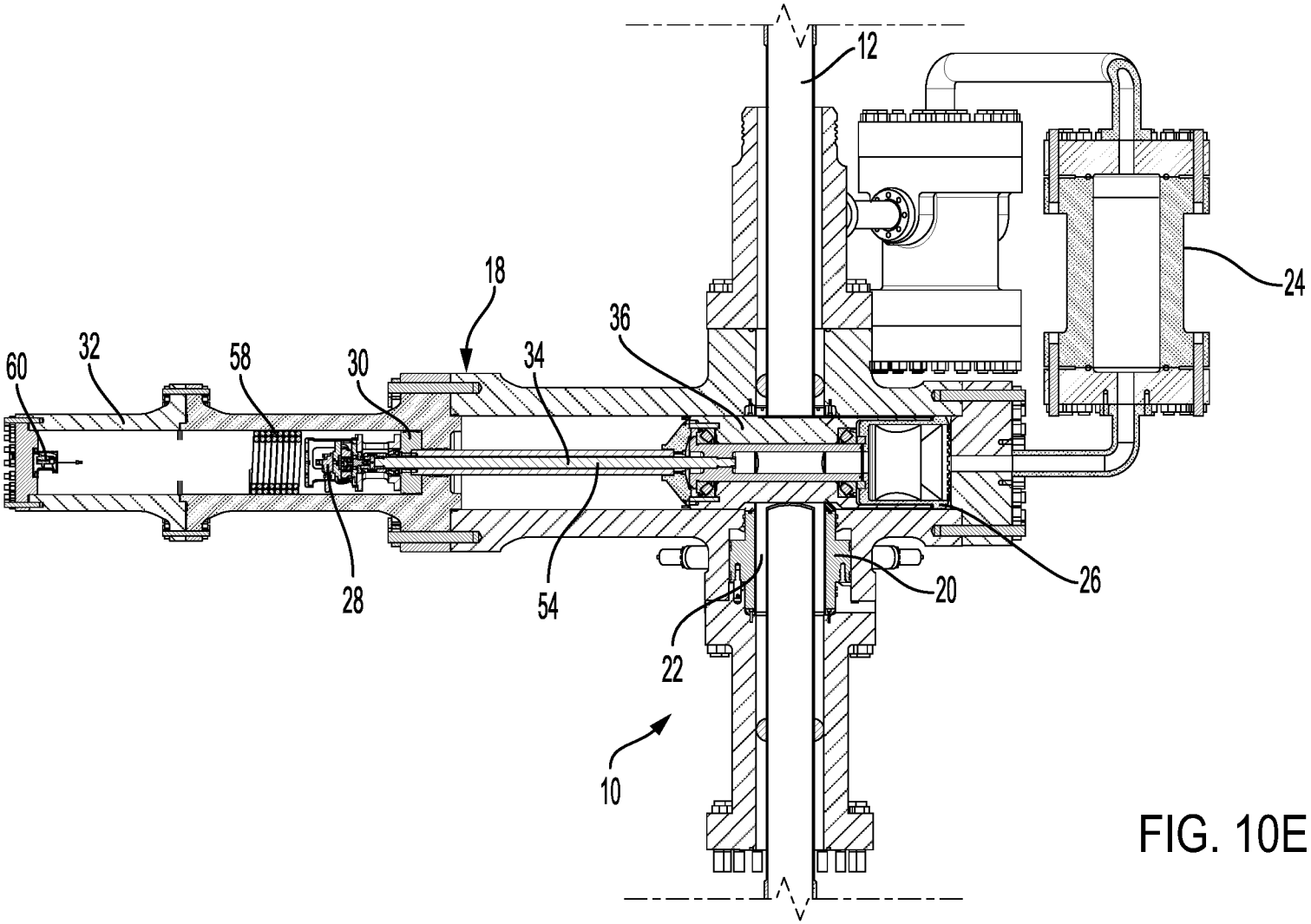

The stroke of the hydraulic piston 30 continues until the hole saw 26 and the corresponding movable protection element 36 reach the opposite part of the tubular material 12 with respect to that on which the cutting and closing group 18 is positioned (FIG. 10E). In this position, the closing portion of the movable protection element 36 is in correspondence with the central hole of the safety valve 10.

Figure 10F:
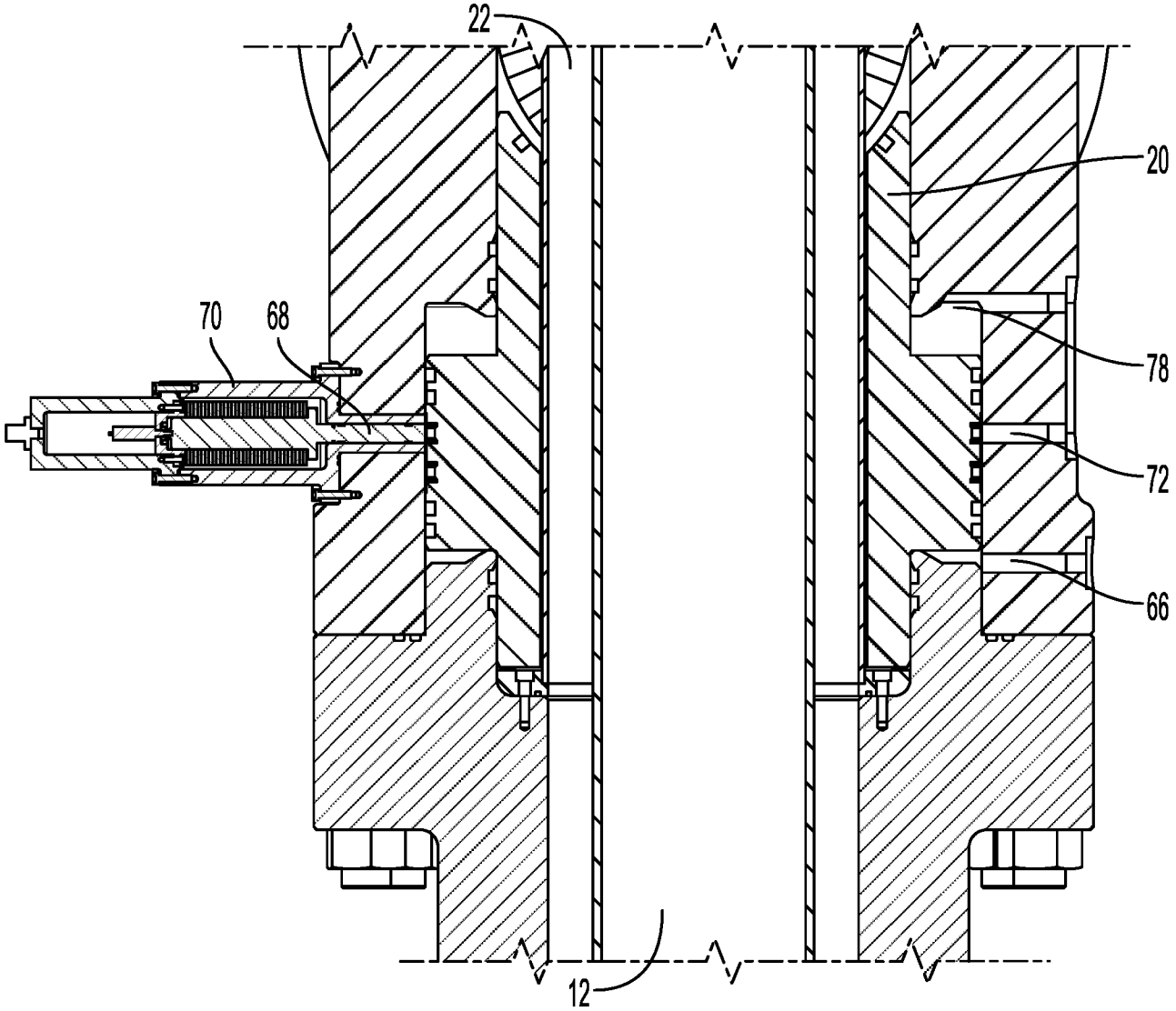
Figure 10G:
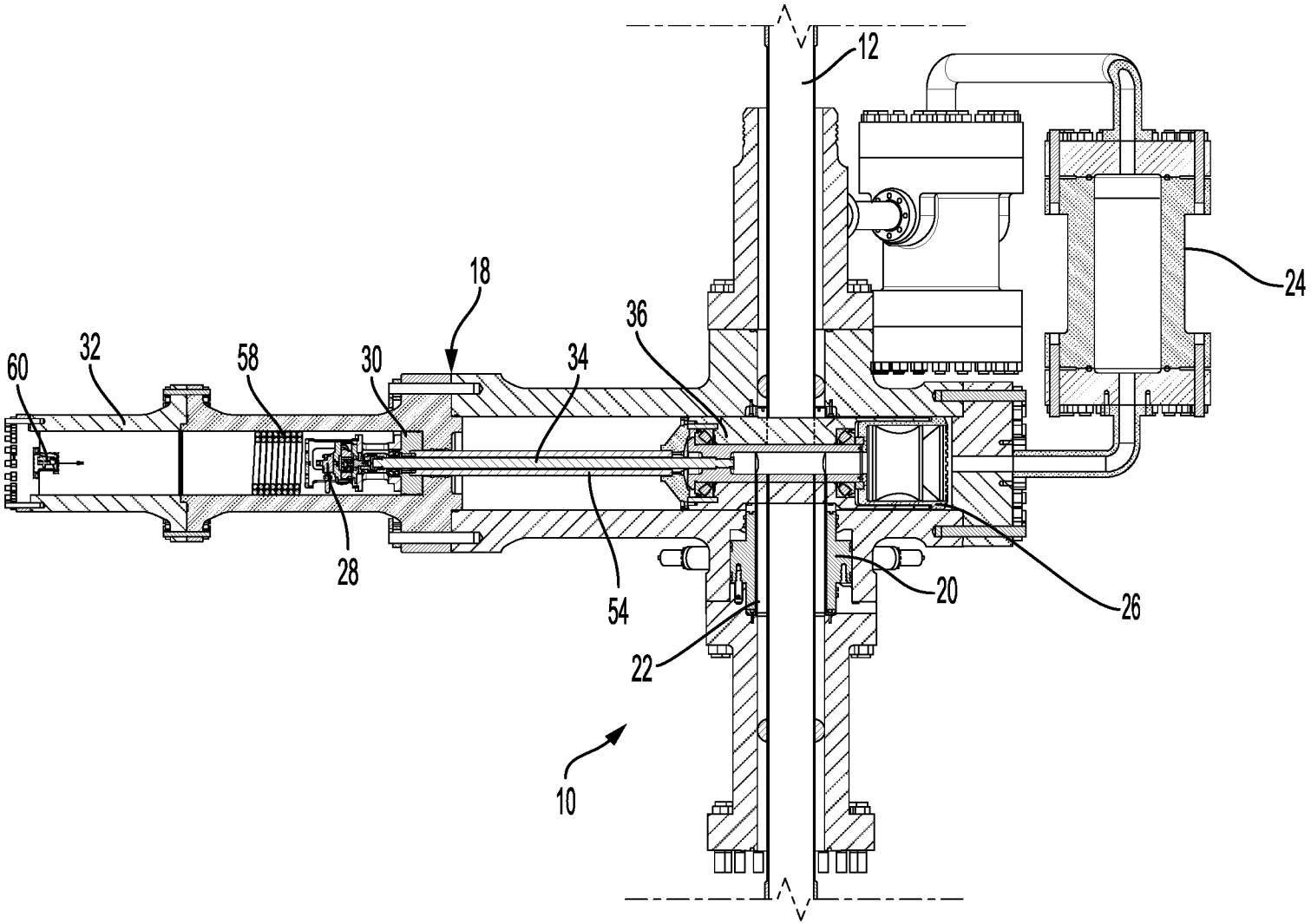

Once the hole saw 26 and the corresponding movable protection element 36 have reached the respective stroke-end positions, the withdrawal of the blocking pins 68 from the sliding closing collar 62, is effected (FIG. 10F). The withdrawal of the blocking pins 68 is obtained by means of a dedicated hydraulic line which sends pressurized fluid into the chamber 72. The fluid counteracts the action of the springs 70 and therefore moves the respective blocking pins 68 away from the sliding closing collar 62.

The introduction of pressurized fluid into the lower thrust chamber 66 causes the consequent upward movement of the sliding closing collar 62 (FIG. 10G), until it forces the sealing portion 64 onto the movable protection element 36, closing the well. The sealing portion 64 of the sliding closing collar 62 can be conveniently pushed inside a corresponding recess formed in the movable protection element 36, so as to block any possible axial movements of said movable protection element 36.

Figure 10H:
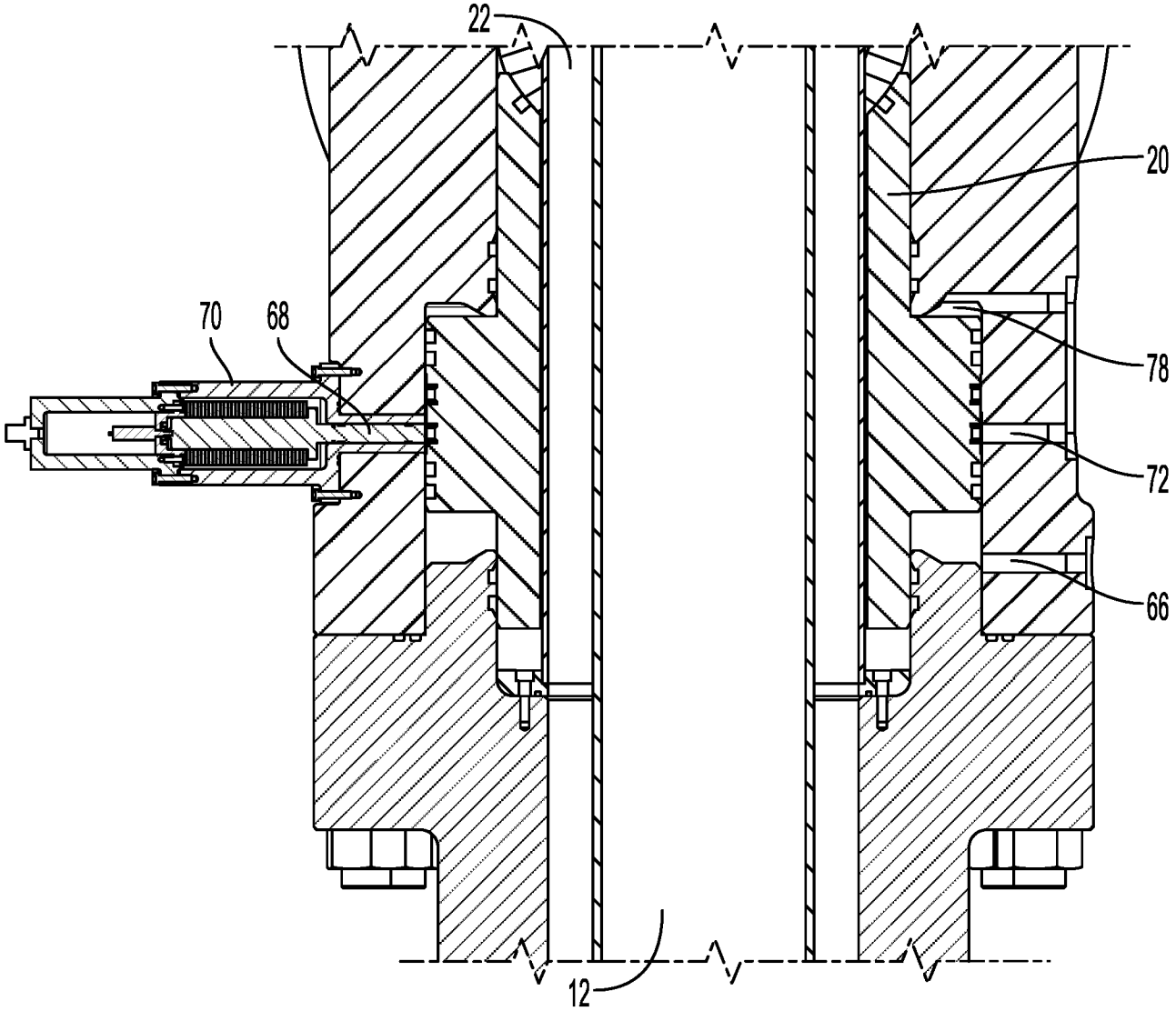

Finally, pressure is removed from the hydraulic actuation line of the blocking pins 68, which, pushed by the respective springs 70, re-enter the corresponding grooves of the sliding closing collar 62 and block the sliding closing collar 62 itself in the closing position (FIG. 10H).

With reference to FIGS. 11A-11E, the operating sequence of the steps performed by the safety valve 10 for operating the re-opening procedure of the well is as follows. A first step consists in actuating the pistons 40 of both the upper blocking clamps 14 and of the lower blocking clamps 16 to release the segments of the drill pipe positioned above and below the cut portion of tubular material 12. The lower segment of tubular material falls into the well, whereas the upper segment of tubular material can be removed from above.

Figure 11A:
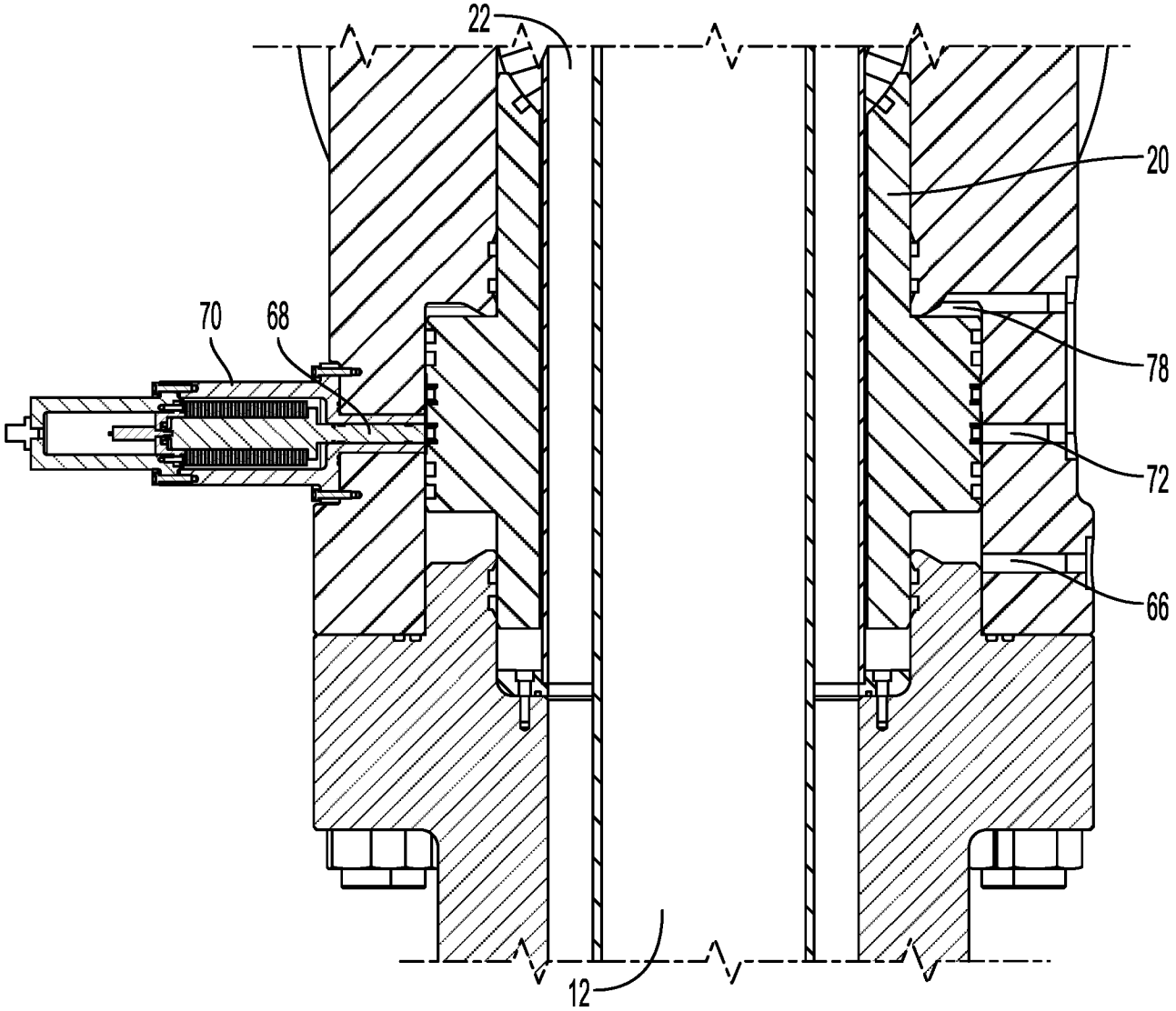
FIGS. 11A-11E respectively show the various phases of the re-opening procedure of the well using the safety valve of FIG. 2.
Figure 11B:
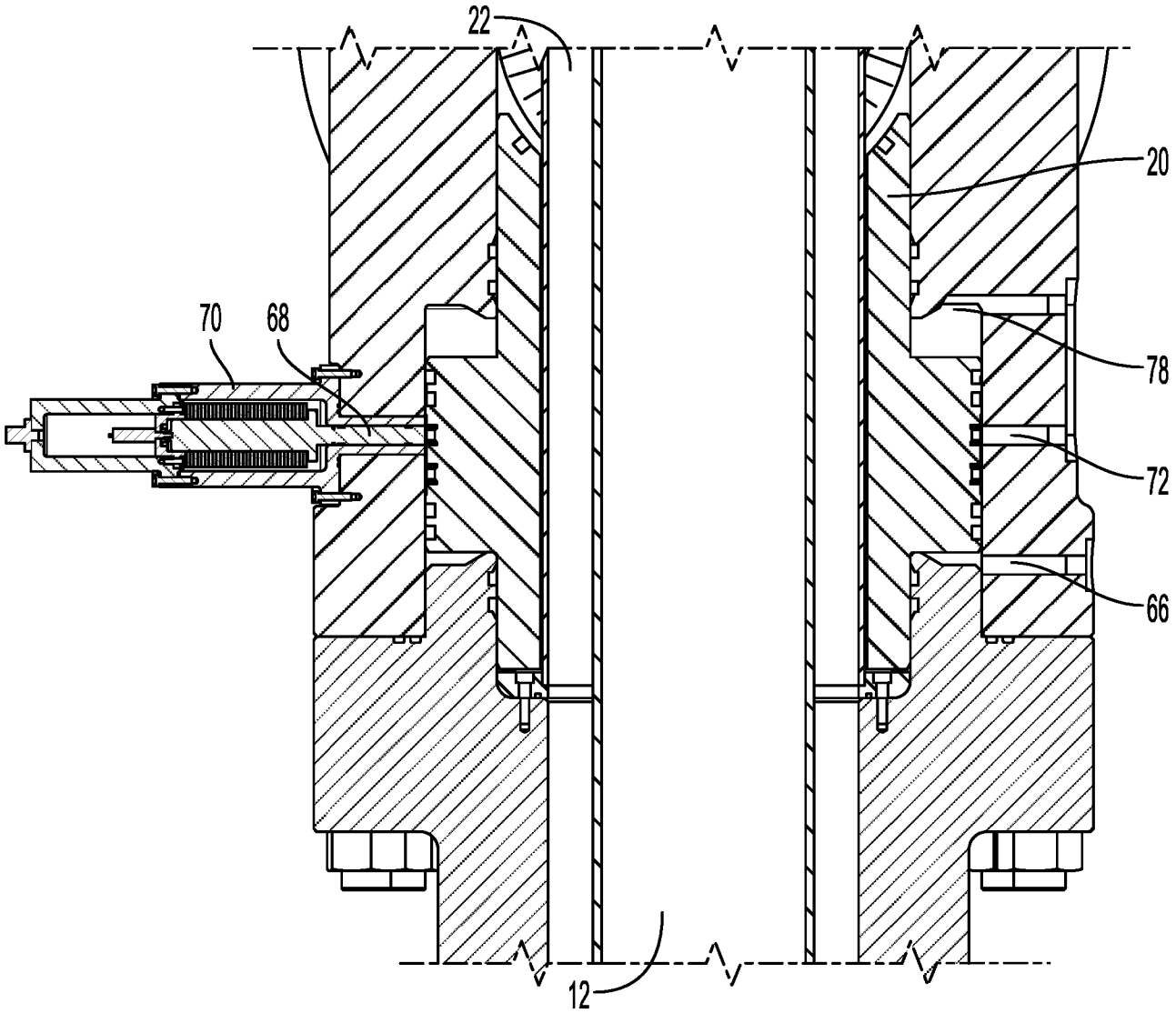

The blocking pins 68 of the sliding closing collar are subsequently moved back by means of the respective hydraulic actuation line (FIG. 11A). By regulating the flow of fluid inside an upper thrust chamber 78, a consequent downward movement of the closing collar 62 is thus caused (FIG. 11B).

Figure 11C:
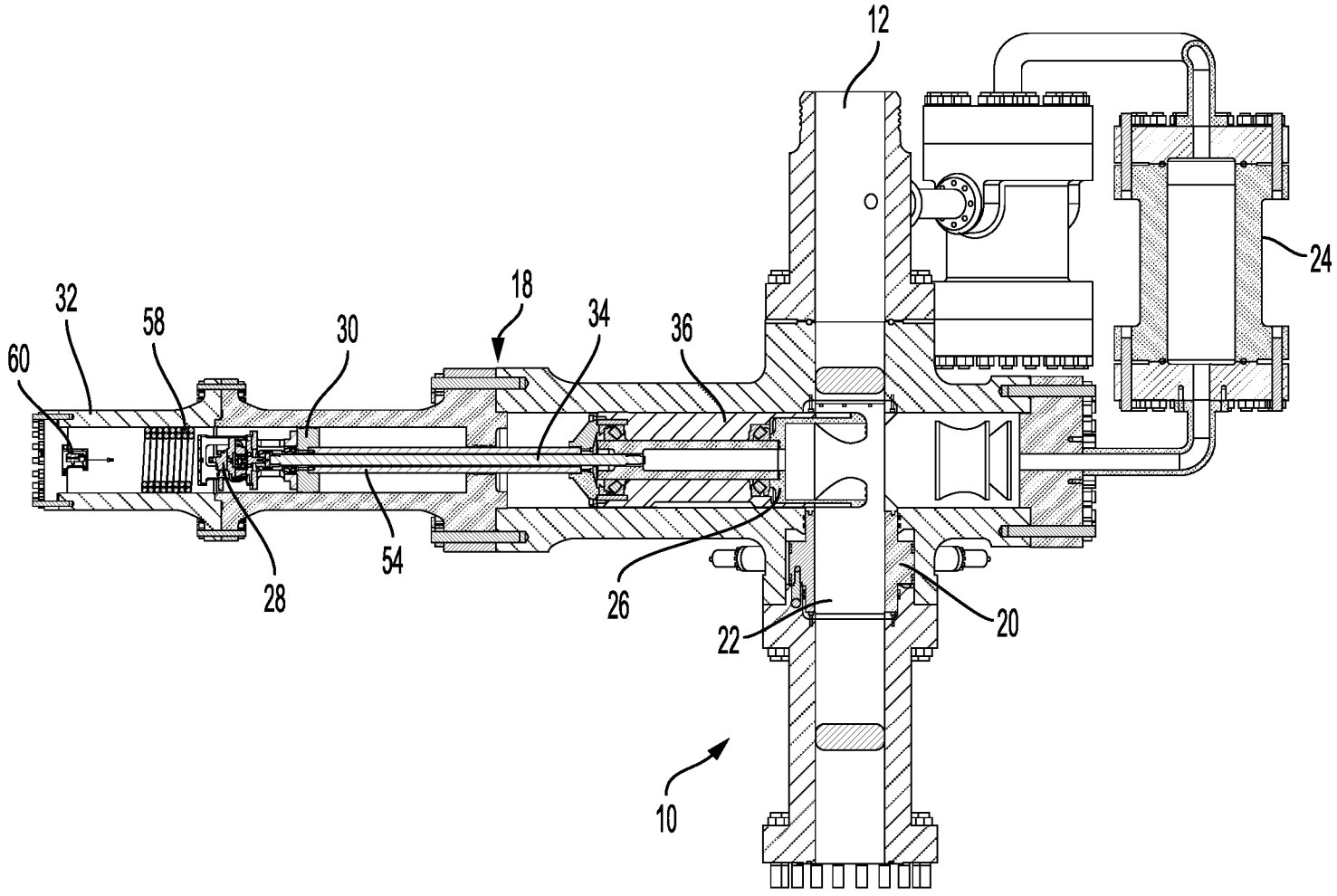
Figure 11D:
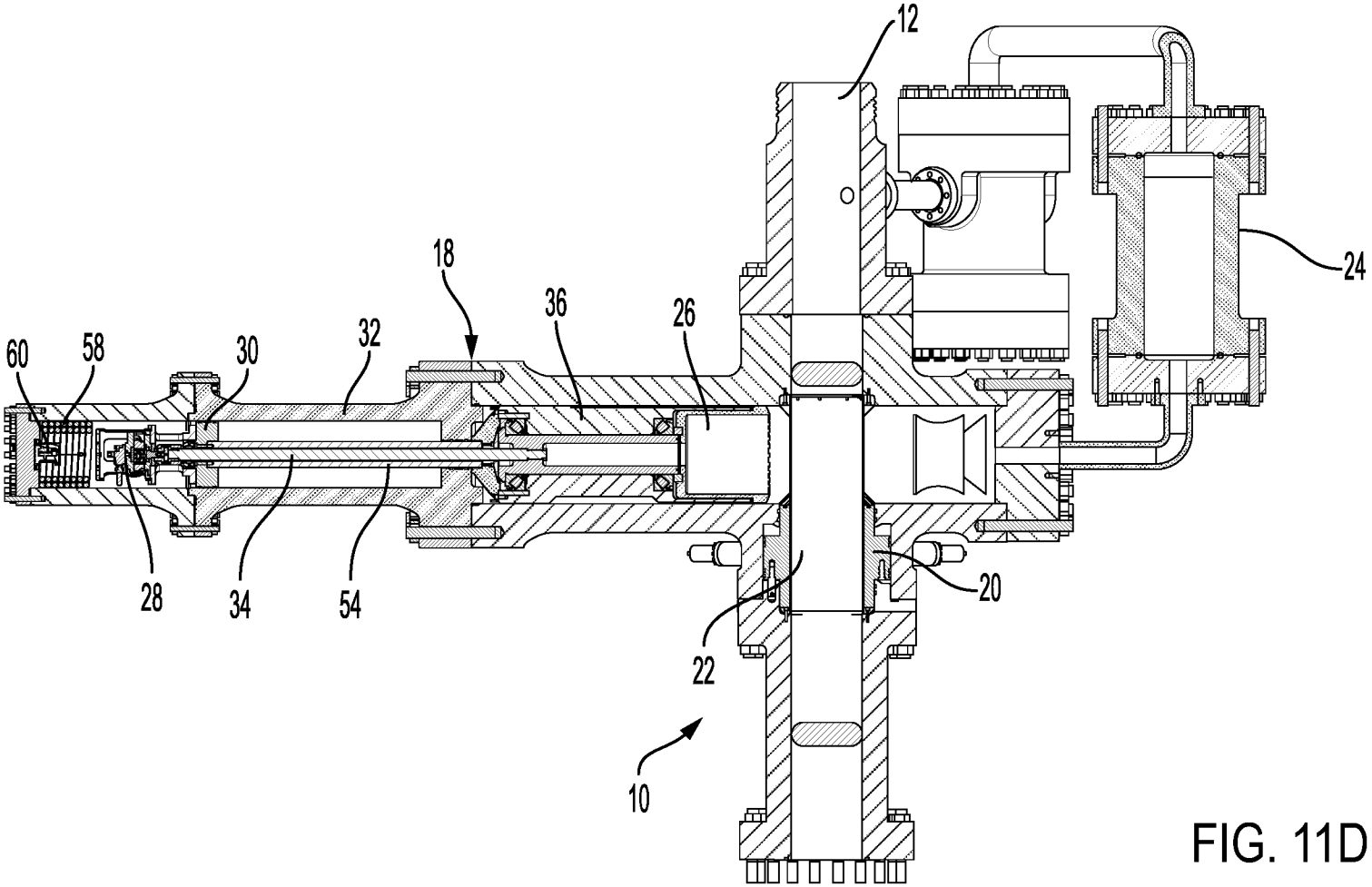
Figure 11E:
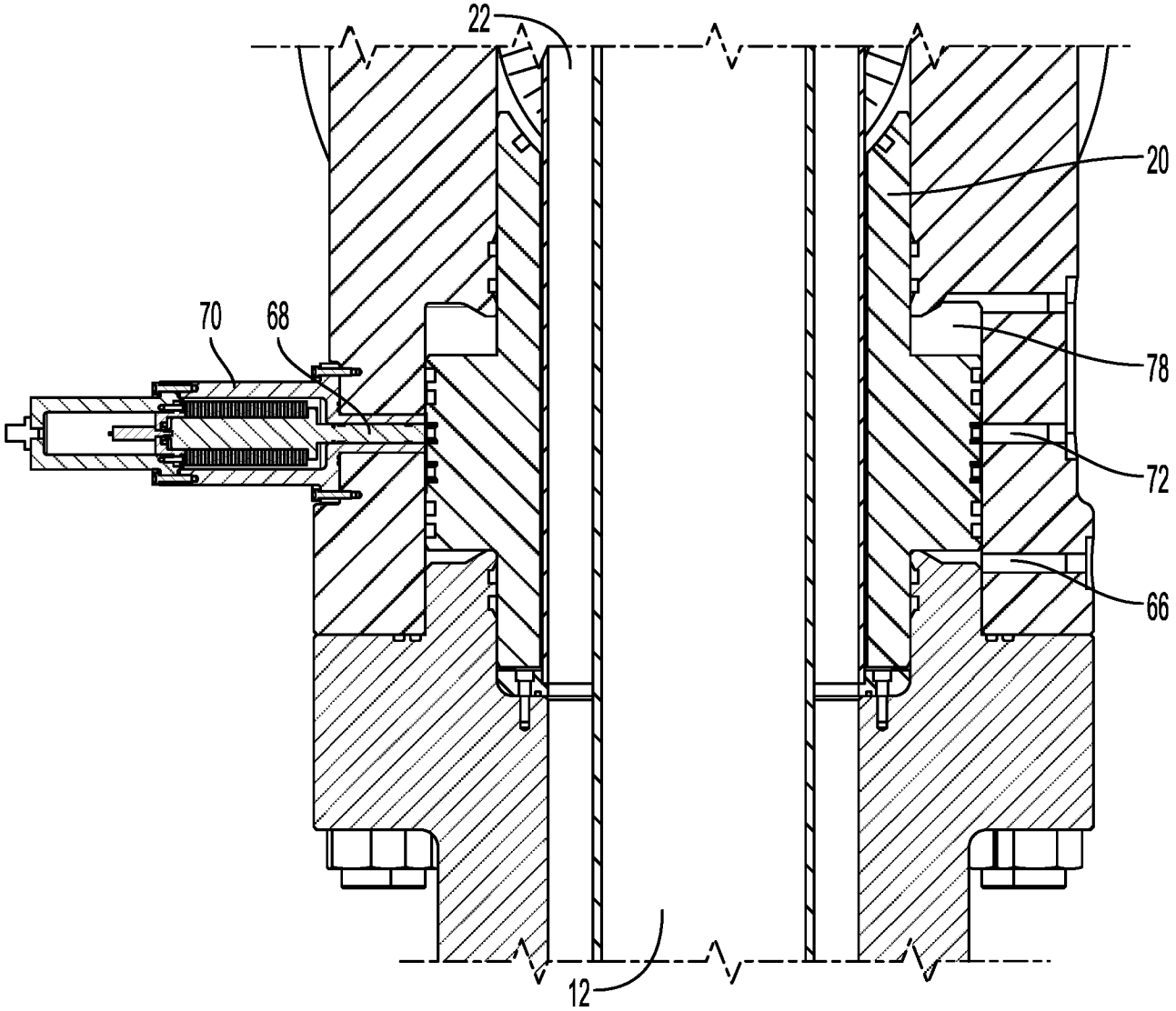

At this point, pressure can be removed from the hydraulic actuation line of the blocking pins 68 which, pushed by the respective springs 70, re-enter the corresponding grooves of the sliding closing collar 62 and block the sliding closing collar 62 itself in the rest position (FIG. 11E).

At this point, the hydraulic piston 30 can be activated for moving back the hole saw 26 in a controlled mode (FIG. 11C). The control is always actuated on the basis of the measurement of the position revealed by the linear sensor 60 and by regulating the supply flow-rate of the actuation fluid to the cylinder 32.

The stroke of the hydraulic piston 30 continues until the hole saw 26 and the respective movable protection element 36 have been brought back to their seats (FIG. 11D).

It can thus be seen that the safety valve for extraction wells of hydrocarbons according to the present invention achieves the objectives previously indicated, obtaining, in particular, the following advantages:

- cutting action of the tubular material based on the removal of shavings, in a manner therefore more versatile with respect to the known devices, considering the variety of geometries to be cut: from tool joints (small diameter, large thickness) to casings (large diameter, small thickness);
- creation of a well-defined cutting surface, so as not to leave metal debris that prevent the subsequent passage of the closing element: the metal debris are, in fact, collected by the hole saw;
- capacity of operating the cutting of the tubular elements also under critical conditions;
- protection of the seals of the piston systems from well fluids, thus avoiding maintenance of the seals and leaving the safety valve installed for the whole operating life of the well.

The safety valve for extraction wells of hydrocarbons according to the present invention thus conceived can in any case undergo numerous modifications and variants, all included in the same inventive concept; furthermore, all the details can be substituted by technically equivalent elements. In practice, the materials used, as also the forms and dimensions, can vary according to technical requirements.

The protection scope of the invention is therefore defined by the enclosed claims.

The invention claimed is:

1. A safety valve for extraction wells, configured to be installed on an oil well head and to enclose a portion of a tubular material inserted inside the well, the tubular material being internally hollow and configured to contain and transport fluids and other substances extracted from the well, the safety valve comprising:

- a central hole through which the tubular material passes;
- a blocking system, configured to firmly keep the tubular material to be cut fixed with respect to the safety valve;
- a cutting and closing group configured to cut and close the well under certain operative conditions; and
- a sealing mechanism, configured to actuate a hydraulic sealing of the well, after the cutting;
- wherein the cutting and closing group includes a hole saw housed in a respective chamber of the cutting and closing group, the hole saw being rotated by a motorized actuation means and being configured to move in a controlled mode along a substantially orthogonal direction with respect to a development direction of the well, and
- wherein a movable protection element is slidingly inserted inside the cutting and closing group, which at least partially surrounds the hole saw and which is configured to move along a same movement direction as the hole saw to arrive into the well and go in contact against the sealing mechanism, to effect hydraulic sealing of the central hole of the safety valve and consequently of the well.

2. The safety valve according to claim 1, wherein the blocking system includes at least one upper blocking clamp, arranged above the cutting and closing group, and at least one lower blocking clamp, arranged below the cutting and closing group.

3. The safety valve according to claim 2, wherein each blocking clamp includes a blocking element configured to engage the tubular material by interference, the blocking element being movable along a direction perpendicular to an axial direction of the well and being pushed by a hydraulically driven piston.

4. The safety valve according to claim 3, wherein each blocking clamp includes a mechanism to allow blocking of the piston in the position reached also in a case of a loss in hydraulic pressure.

5. The safety valve according to claim 3, wherein each blocking clamp includes a position sensor that allows a stroke of the blocking element to be exactly controlled to center a portion of tubular material enclosed inside the safety valve.

6. The safety valve according to claim 3, wherein each blocking clamp includes an elastic bellows configured to protect seals of a stem of the piston and the blocking element from the well fluids.

7. The safety valve according to claim 1, wherein the cutting and closing group includes a hydraulic piston housed inside a respective cylinder, the hydraulic piston being actuated for imparting a controlled linear movement to both the hole saw and the movable protection element.

8. The safety valve according to claim 7, wherein the motorized actuation means rotates the hole saw by a transmission shaft inserted inside a stem of the hydraulic piston.

9. The safety valve according to claim 7, wherein the motorized actuation means includes a hydraulic motor integral with the hydraulic piston and fed by a series of flexible sleeves that follow the hydraulic motor during translation movement of the hydraulic piston, a linear sensor continuously providing a position of the hydraulic piston inside the respective cylinder.

10. The safety valve according to claim 1, wherein the sealing mechanism includes a sliding closing collar configured to envelope the tubular material, the sliding closing collar including a sealing portion configured to force contact with the movable protection element and being actuated by hydraulic pressure of a fluid contained in at least one thrust chamber obtained inside the sealing mechanism.

11. The safety valve according to claim 10, wherein the sealing mechanism includes one or more blocking pins configured to block the sliding collar in one or more predefined positions, the one or more blocking pins being pushed into corresponding grooves of the sliding closing collar by one or more corresponding springs retractable by thrust of a pressurized fluid contained in a respective chamber obtained inside the sealing mechanism.

12. The safety valve according to claim 1, further comprising a protection element including a sleeve mounted around the central hole of the safety valve and sealing rings to keep the central hole of the safety valve separate from the chamber in which the hole saw is housed.

13. The safety valve according to claim 12, further comprising a pressure-compensating device configured to fill the chamber in which the hole saw is housed with an inert fluid kept at a same pressure as the well.

14. The safety valve according to claim 1, further comprising a remote power and control system installed at a predefined distance from the well, the remote power and control system being operatively connected to the safety valve by electric and hydraulic connections including a remotely operated underwater vehicle.

15. A method for closing of a well, comprising:

fixing a safety valve onto a well head, so that a portion of a tubular material inserted inside the well is enclosed inside a central hole of the safety valve and a cutting and closing group of the safety valve is positioned in correspondence with the tubular material;

actuating rotation of a hole saw belonging to the cutting and closing group and controlling advancing of the hole saw along a direction substantially orthogonal to a development direction of the well, to effect progressive cutting of the tubular material;

controlling advancing of a movable protection element slidingly inserted inside the cutting and closing group, the movable protection element at least partially surrounds the hole saw and being configured to move along a same movement direction as the hole saw to arrive into the well and go in contact against a sealing mechanism, to effect hydraulic sealing of the central hole of the safety valve; and activating the sealing mechanism of the safety valve, the sealing mechanism being seal-engaged against the movable protection element to effect watertight closing of the central hole of the safety valve and therefore the well.

16. The method according to claim 15, wherein the method is reversible, thus allowing re-opening of the well.

* * * * *